US008636160B2

(12) United States Patent
Park

(10) Patent No.: US 8,636,160 B2
(45) Date of Patent: Jan. 28, 2014

(54) SAFETY CONTAINER WITH SAFETY LOCKING PART

(76) Inventor: Suk Woo Park, Seoul (KR)

( * ) Notice: Subject to any disclaimer, the term of this patent is extended or adjusted under 35 U.S.C. 154(b) by 875 days.

(21) Appl. No.: 12/303,223

(22) PCT Filed: May 31, 2007

(86) PCT No.: PCT/KR2007/002660

§ 371 (c)(1),
(2), (4) Date: Dec. 2, 2008

(87) PCT Pub. No.: WO2007/142429

PCT Pub. Date: Dec. 13, 2007

(65) Prior Publication Data

US 2009/0145873 A1 Jun. 11, 2009

(30) Foreign Application Priority Data

Jun. 2, 2006 (KR) ..... 10-2006-0050034

(51) Int. Cl.
*B65D 50/02* (2006.01)
*B65D 55/16* (2006.01)
*B65D 43/14* (2006.01)

(52) U.S. Cl.
USPC ..... 215/201; 215/208; 215/237; 215/306

(58) Field of Classification Search
USPC ..... 215/201, 208, 211, 213, 214, 237, 306, 215/354, 43, 45, 204; 222/153.04, 153.09, 222/153.14; 116/306, 311, 315; 220/375, 220/837, 786, 802
See application file for complete search history.

(56) References Cited

U.S. PATENT DOCUMENTS

| | | | | | |
|---|---|---|---|---|---|
| 491,729 | A | | 2/1893 | McCarthy | |
| 3,090,518 | A | | 5/1963 | Norway | |
| 3,567,058 | A | | 3/1971 | Mascia | |
| 3,623,622 | A | * | 11/1971 | Sullivan | 215/213 |
| 3,669,295 | A | * | 6/1972 | Horvath | 215/206 |
| 4,991,729 | A | | 2/1991 | Hunter | |
| 6,082,572 | A | | 7/2000 | Galton-Fenzi et al. | |

FOREIGN PATENT DOCUMENTS

| | | |
|---|---|---|
| CH | 187395 | 1/1937 |
| CN | 1711197 | 12/2005 |
| JP | 08-324617 | 12/1996 |
| JP | 2002-160716 | 6/2002 |
| JP | 2005-335793 | 12/2005 |
| KR | 20-0417215 | 5/2006 |
| WO | WO 2004/041671 | 5/2004 |

* cited by examiner

*Primary Examiner* — Robin Hylton
(74) *Attorney, Agent, or Firm* — Christopher Paul Mitchell

(57) ABSTRACT

An openable and closable safety container for a hazardous material is provided. The safety container comprises a container part, a lid part coupled to the container part, and a safety locking part installed in the lid part such that the lid part is opened or closed upward after being turned. The lid part is turned horizontally to unlock the locked state and pushed upward to open the lid part. Therefore, the safety container is very safe.

11 Claims, 13 Drawing Sheets

SAFETY CONTAINER WITH SAFETY LOCKING PART

TECHNICAL FIELD

The present invention relates to an openable and closable safety container (hereinafter, also referred to simply as a 'safety container') for a hazardous material, and more specifically to a safety container whose opening and closing are effected through two separate stages, i.e. locking and unlocking operations, so that infants and children cannot easily open it and whose hermetic sealing is improved to prevent a content from being deteriorated in quality.

BACKGROUND ART

Drinking or inhalation of a variety of household chemical goods, such as detergents and adhesives, and drugs causes addiction and poisoning, which pose health and safety hazards.

To protect infants and children from the hazards, regulatory guidelines have been introduced to package hazardous chemical goods and drugs in safety containers. Under such circumstances, many safety containers have been suggested to prevent infants and children's addiction and poisoning to hazardous household chemical goods and drugs. These safety containers allow adults to easily open them but do not permit infants younger than five years to take contents out of them.

Representative safety containers for hazardous materials are classified into two types: push down & turn cap type containers whose lids are opened by pushing down and turning them; and squeeze cap type containers whose lids are opened by turning while pressurizing their both sides.

Korean Utility Model Application No. 20-2005-26060 discloses a safety cap of a push down & turn cap type. This safety cap is comprised of a lower cap 10 coupled to an opening of a container 1 and an upper cap 20 coupled to the upper surface of the lower cap. The upper and lower caps 20 and 10 are configured to be optionally engaged with each other to be simultaneously opened. The lower cap 10 has lower cap projections 11 formed along the edge of its upper surface to be arranged upward at regular intervals. The upper cap 20 has upper cap projections 21 capable of being fitted into the respective lower cap projections 11 when being pushed down and a downwardly curved portion 22 formed at a central underside of its upper surface. The curved portion is at a certain distance apart from the lower cap projections 11 of the lower cap 10 before the upper cap is pushed down. When the upper cap is pushed down, the curved portion is in contact with the upper surface 13 of the lower cap 10 so that its diameter is increased, and the lower cap projections 11 are fitted into the respective upper cap projections 21.

The operation of the safety cap is as follows. First, the upper cap 20 is turned in a counterclockwise direction while being pushing down. At this time, both the upper 20 and lower caps 10 are turned to allow a skirt 16 to be separated from a tear strip 17 by hook protrusions of the container 1. Subsequently, both the upper and lower caps 20 and 10 are separated from the container 1.

The curved portion 22 formed at a central underside of the upper surface 26 of the upper cap is protruded downward such that it can support and push the upper surface 13 of the lower cap 10 when the upper cap is pushed down. The curved portion 22 has a height such that the contact between slopes 11-2 and 21-2 of the respective cap projections is blocked. Due to the height of the curved portion 22, the upper cap 20 is turned on its own axis and the lower cap 10 is in a coupled state with the container 1. This configuration makes it difficult to operate the safety cap. As a result, infants and children have difficulty in opening the safety cap.

However, the number of the parts and members constituting the safety cap of a push down & turn cap type is large and the shapes of the parts and members delivering a turning force are complex, making it difficult to produce the safety cap by injection molding.

The safety cap suffers from several problems during use. The container is filled with a content, such as a drug, and is sealed with the cap (capping). This capping is completed by turning the cap while pressurizing the cap to the container. The capping makes the finishing procedure more complex and requires an additional system, resulting in increased production costs and poor production efficiency of the final product filled with a content, such as a drug.

This complex structure of the safety cap makes the installation of a functional means for counterfeit prevention difficult. A simple counterfeit-preventing means, such as a label paper, is currently installed on the safety cap. Therefore, the safety cap involves a possibility of imitation and copying.

Particularly, the push down & turn cap type container has been already known to the public for many years. At present, the opening/closing operations of the safety cap are commonly employed. Therefore, the safety of the safety cap cannot be expected in infants and children.

Korean Utility Model Application No. 20-2005-31922 suggests a safety cap of a squeeze cap type. The safety cap is fastened to a neck portion 3 of a container 2 via threads. A latching step 4 formed along the inner circumferential surface of the neck portion 3 is hooked and supported by a latch ring 7 connected to a separation portion 6 formed at a lower portion of the cap 5. The cap 5 has lateral pressurization portions 10 formed at its both sides to allow the cap 5 to be pressurized in an inward direction. Each of the lateral pressurization portions 10 has threads 12 formed at its inner circumference. The threads 12 of the lateral pressurization portions 10 are in an unengaged state with threads 13 formed at the outer circumference of the neck portion 3 before the lateral pressurization portions 10 are pressurized in an inward direction. Only when the lateral pressurization portions 10 are pressurized in an inward direction, the threads 12 of the lateral pressurization portions 10 are engaged with the threads 13 of the neck portion 3. By this configuration, the opening/closing operations of the cap can be achieved.

That is, the prior art safety cap is configured such that only when the lateral pressurization portions 10 formed at both sides of the cap 5 are pressurized in an inward direction, the threads 12 formed at the inner circumference of the lateral pressurization portions 10 are engaged with the threads 13 of the neck portion 3 to open the cap 5.

The cap of a squeeze type can be opened by simultaneous pressurization of the pressurization portions and turning. That is, the opening of the cap is dependent on the pressurization and turning forces. Accordingly, the cap can be opened without any particular difficulty, making it difficult to ensure effectiveness required in packages for the protection of infants and children from hazardous materials.

DISCLOSURE OF INVENTION

Technical Problem

Therefore, it is a main object of the present invention to provide an openable and closable safety container for a hazardous material wherein a lid part is turned from a container part to unlock a safety locking mode between the lid part and the container part and the lid part is pushed upward to be opened, i.e., opening and closing of the lid part are effected through two separate stages, which are different from opening/closing operations of conventional safety containers through two simultaneous stages, so that infants and children cannot easily open the safety container, thereby achieving improved safety of the safety container.

It is an object of the present invention to provide an openable and closable safety container for a hazardous material wherein the lid part is turned from the container part to generate a frictional sound and a safety locking position is set into a safety unlocking position to generate no frictional sound, thereby allowing a user to readily discern the safety locked state between the lid part and the container part depending on whether the frictional sound is generated or not.

It is a further object of the present invention to provide an openable and closable safety container for a hazardous material wherein when reference points formed on a belt means and a cover means of the lid part are matched, a user can visually recognize whether the lid part is in a safety locked state in an easy and simple manner.

It is another object of the present invention to provide an openable and closable safety container for a hazardous material wherein an extended jaw is formed in a coupling flange of the lid part to allow an entrance end portion of the container part to be opened at a limited angle when the lid part is opened, thereby preventing a content of the container part from flowing out of the container part by fluctuation, which may be generated when the lid part is opened.

It is another object of the present invention to provide an openable and closable safety container for a hazardous material wherein a stepped latching portion and a sealing protrusion are formed on the inner circumference of the container part to be coupled to a sealing flange and a coupling flange of the lid part in a double structure so that the sealing state of an internal space of the container part can be improved, thereby preventing a content of the container part from being deteriorated in quality by ambient air.

It is another object of the present invention to provide an openable and closable safety container for a hazardous material wherein turning stoppers are formed symmetrically to each other on the inner circumference of the container part to limit the turning angle of the locking protrusion determining the safety locked state so that the operational effectiveness associated with unlocking of the safety locked state can be improved in a more rapid manner.

It is another object of the present invention to provide an openable and closable safety container for a hazardous material wherein a broken-type tear strip is integrally joined along the end portion of the outer circumferential surface of the container part corresponding to a cover means and a belt means of the lid part to effectively check and maintain the initial state of the safety container before opening after the lid part is coupled to the container part accommodating a content.

It is yet another object of the present invention to provide an openable and closable safety container for a hazardous material wherein the container part filled with a content, such as a drug, is capped with the lid part by pressurization so that the finishing procedure can be carried out in a simple and easy manner to achieve reduced production costs, and a tear strip is joined integrally to the container part to perform counterfeit-preventing functions so that the reliability of the final product can be improved.

Technical Solution

In order to accomplish the above objects of the present invention, there is provided an openable and closable safety container for a hazardous material, comprising: a container part having an entrance end portion whose top is opened, a stepped latching portion formed at the lower end of the entrance end portion so as to be protruded inward and having an elongated groove partially formed therein, and a guide step formed along its outer circumferential surface at the lower end of the stepped latching portion; a lid part having a linker, a belt means turnably coupled to the stepped latching portion of the container part, and a cover means integrally connected to the belt means by the linker to open and close the entrance end portion; and a safety locking part coupled to the lid part in a vertical downward direction to be operated integrally with the lid part and having a locking protrusion protruding outward from its outer circumferential surface, the locking protrusion being positioned in the stepped latching portion or the elongated groove by a turn of the lid part to optionally open or close the lid part.

Specifically, the container part has an entrance end portion whose top is opened, a guide step formed in a stepwise fashion along its outer circumferential surface below the entrance end portion, and a stepped latching portion formed along its inner circumferential surface at the lower end of the entrance end portion so as to be protruded inward and having an elongated cut-away groove partially formed therein; the lid part has a freely bendable linker, a belt means having a slide step formed along its inner circumferential surface so as to be turnably coupled to the stepped latching portion of the container part, a cover means integrally connected to the belt means by the linker, a sealing flange provided in a vertical downward direction at a circumferential edge of the cover means to allow a stepped sealing portion protruding from its inner circumference to be elastically latched to an outer circumference of the entrance end portion, a coupling flange provided inside the sealing flange to have the same center of curvature as the sealing flange, a stepped coupling portion formed along the inner circumferential surface of the coupling flange, and a knob extending from an outer circumference of the sealing flange; and the safety locking part has a fixing step formed along its outer circumferential surface to be coupled to an inner circumference of the coupling flange of the lid part and be elastically latched to the stepped coupling portion of the lid part so that it is joined integrally to the lid part, and a locking protrusion protruding outward from its lower end, the locking protrusion being operated integrally with the lid part to be positioned at a lower end of the stepped latching portion through the elongated groove of the container part and to optionally maintain or unlock the latched state between the lid part and the container part by a turn of the lid part.

According to another embodiment of the present invention, there is provided an openable and closable safety container for a hazardous material, comprising: a container part having an entrance end portion whose top is opened, a guide step formed in a stepwise fashion along its outer circumferential surface below the entrance end portion, a sealing protrusion protruding in a stepwise fashion on its inner circumference at the lower end of the entrance end portion, and a stepped latching portion protruding in a stepwise fashion on its inner circumference at the lower end of the entrance end portion and having an elongated groove partially formed therein, the stepped latching portion being more inwardly protruded than the sealing protrusion; a lid part having a freely bendable linker, a belt means having a slide step formed along its inner circumferential surface so as to be turnably coupled to the stepped latching portion of the container part, a cover means integrally connected to the belt means by the linker, a sealing flange provided in a vertical downward direction at a circumferential edge of the cover means to allow a stepped sealing portion protruding from its inner circumference to be elastically latched to an outer circumference of the entrance end portion of the container part, a coupling flange provided inside the sealing flange to have the same center of curvature as the sealing flange, so that an outer circumference of the coupling flange is in close contact with the stepped latching portion upon being coupled to the container part, thereby hermetically sealing the container part, a stepped coupling portion formed along the inner circumferential surface of the coupling flange, and a knob extending from an outer circumference of the sealing flange; and a safety locking part having a fixing step formed along its outer circumferential surface to be coupled to an inner circumference of the coupling flange of the lid part and be elastically latched to the stepped coupling portion of the lid part so that it is joined integrally to the lid part, and a locking protrusion curved inward from a lower portion of the fixing step to be protruding outward from its lower end, the locking protrusion being operated integrally with the lid part without interfering with the sealing protrusion of the container part to be positioned at a lower end of the stepped latching portion through the elongated groove of the container part and to optionally maintain or unlock the latched state between the lid part and the container part by a turn of the lid part.

The safety container further comprises indicator projections formed successively in a row along the outer circumferential surface of the container part between the steps of the guide step of the container part and a position display end portion formed in the indicator projections to have the same width as the elongated groove of the container part so that a frictional projection formed under the slide step of the belt means is partially engaged with the indicator projections to generate a frictional sound between the indicator projections and the frictional projection upon being turned to open the lid part from the container part or to generate no frictional sound when the locking protrusion is positioned in the elongated groove and the frictional projection is escaped from the indicator projections to be positioned at the position display end portion.

The lid part further has a linear jaw extending from a rear end of the coupling flange and latched to the entrance end portion of the container part to limit the opening/closing angle of the lid part, which is opened and closed from the container part by the linker.

The container part further has turning stoppers formed symmetrically to each other on the inner circumference of the entrance end portion of the container part to limit the turning angle of the lid part.

The lid part further has a guide protrusion formed in a vertical position on an inner circumference of the coupling flange and the safety locking part has a guide recess formed in a position corresponding to the guide protrusion on its outer circumference so that the guide protrusion is fitted into the guide recess to allow the safety locking part to be coupled to the lid part in an exact position.

Advantageous Effects

The safety container of the present invention provides the following advantageous effects.

The safety container of the present invention can be safely opened through two separate stages, which are different from opening/closing operations of conventional safety containers through two simultaneous stages, so that infants and children cannot easily open the safety container, thereby ensuring improved safety of the safety container.

In addition, a user can discern the safety locked/unlocked states of the safety container depending on whether a frictional sound is generated and reference lines are matched, so that he/she can readily conceive the safety locked state, thereby effectively achieving improved operational effectiveness of the safety container.

Further, the entrance end portion of the container part is opened at a limited angle when the lid part is opened to effective prevent a content of the container part from flowing out of the container part by fluctuation, which may be generated when the lid part is opened.

Further, the container part and the lid part are sealed in a double structure so that the sealing state of the container part can be improved, thereby effectively preventing a content filled in the container part from being deteriorated in quality by ambient air.

Further, the turning angle of the locking protrusion determining the safety locked state is limited so that the operational effectiveness associated with unlocking of the safety locked state can be further improved.

Furthermore, since the initial state of the safety container before opening can be checked, the reliability of a content filled in the safety container against opening can be improved.

Moreover, the container part filled with a content, such as a drug, is capped with the lid part by pressurization so that the finishing procedure can be carried out in a simple and easy manner to achieve reduced production costs of the final product, and a tear strip is joined integrally to the container part to perform counterfeit-preventing functions so that the reliability of the final product can be improved.

BEST MODE FOR CARRYING OUT THE INVENTION

Figure 1:
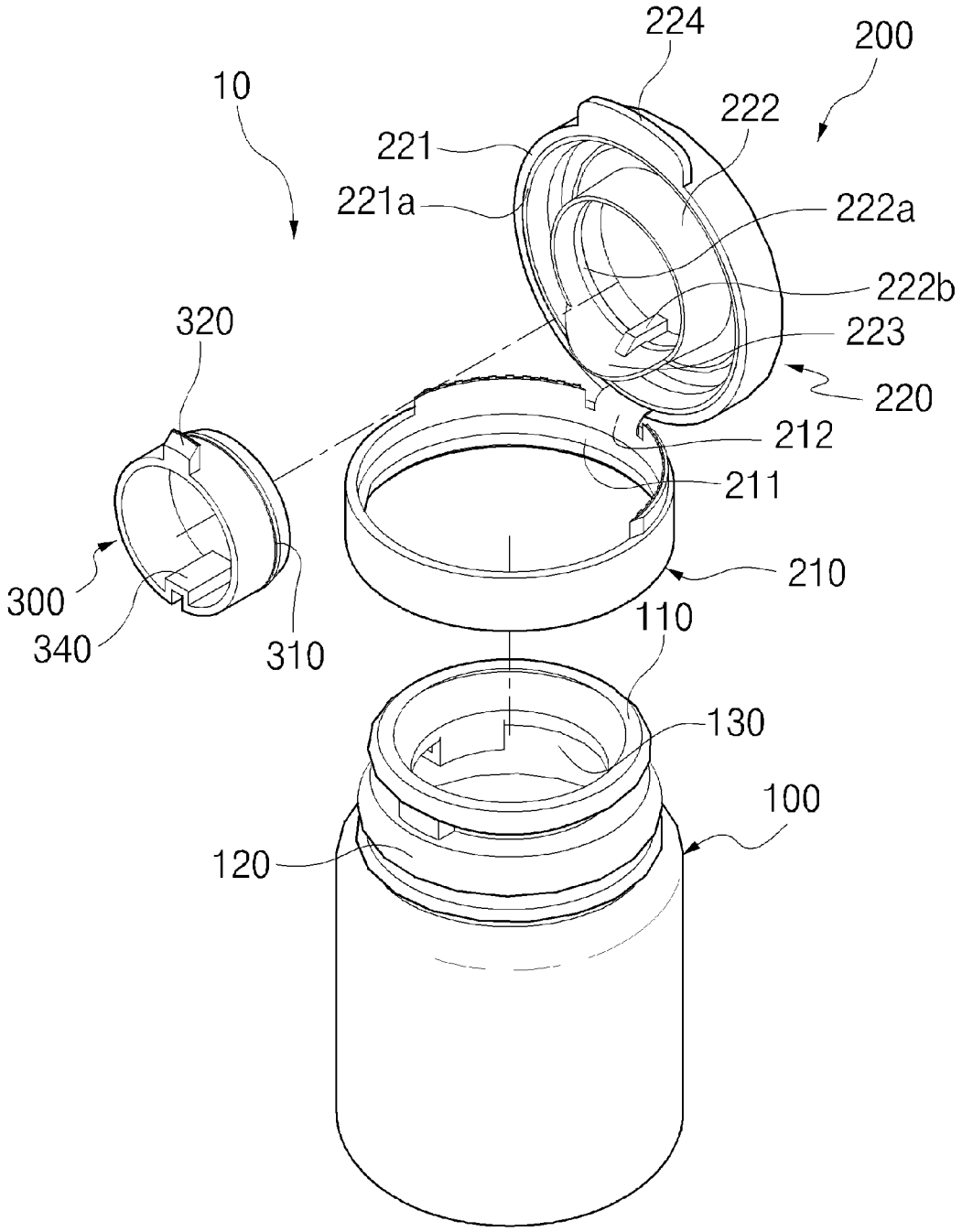
FIG. 1 is an exploded perspective view showing an openable and closable safety container for a hazardous material according to the present invention.

Preferred embodiments of the present invention will now be described in greater detail with reference to the accompanying drawings.

It should be noted that, wherever possible, the same reference numerals represent the same elements or parts throughout the drawings. For the purpose of clarity, a detailed description of known functions and configurations incorporated herein will be omitted as they may make the subject matter of the present invention unclear.

As shown in FIGS. 1 to 10, the safety container of the present invention comprises: a container part 100 having an entrance end portion 110 whose top is open, a stepped latching portion 130 formed at the lower end of the entrance end portion so as to be protruded inward and having an elongated groove 140 partially formed therein, and a guide step 120 formed along its outer circumferential surface at the lower end of the stepped latching portion 130; a lid part 200 having a linker 212, a belt means 210 turnably coupled to the guide step 120 of the container part 100, and a cover means 220 integrally connected to the belt means 210 by the linker 212 to open and close the entrance end portion 110; and a safety locking part 300 coupled to the lid part 200 in a vertical downward direction to be operated integrally with the lid part 200 and having a locking protrusion 320 protruding outward from its outer circumferential surface, the locking protrusion 320 being positioned in the stepped latching portion 130 or the elongated groove 140 by a turn of the lid part 200 to optionally open or close the lid part 200.

The container part has an entrance end portion 110 whose top is open, the guide step 120 formed in a stepwise fashion along its outer circumferential surface below the entrance end portion 110, and the stepped latching portion 130 formed along its inner circumferential surface at the lower end of the entrance end portion so as to be protruded inward and having the elongated cut-away groove 140 partially formed therein.

The lid part 200 has freely bendable linker 212, the belt means 210 having a slide step 211 formed along its inner circumferential surface so as to be turnably coupled to the guide step 120 of the container part 100, the cover means 220 integrally connected to the belt means 210 by the linker 212, a sealing flange 221 provided in a vertical downward direction at a circumferential edge of the cover means 220 to allow a stepped sealing portion 221*a* protruding from its inner circumference to be elastically latched to an outer circumference of the entrance end portion 110, a coupling flange 222 provided inside the sealing flange 221 to have the same center of curvature as the sealing flange 221, a stepped coupling portion 222*a* formed along the inner circumferential surface of the coupling flange 222, and a knob 224 extending from an outer circumference of the sealing flange 221.

The safety locking part 300 has a fixing step 310 formed along its outer circumferential surface to be coupled to an inner circumference of the coupling flange 222 of the lid part 200 and be elastically latched to the stepped coupling portion 222*a* of the lid part 200 so that it is joined integrally to the lid part 200, and a locking protrusion 320 protruding outward from its lower end, the locking protrusion 320 being operated integrally with the lid part 200 to be positioned at a lower end of the stepped latching portion 130 through the elongated groove 140 of the container part 100 and to optionally maintain or unlock the latched state between the lid part 200 and the container part 100 by a turn of the lid part 200.

Figure 8:
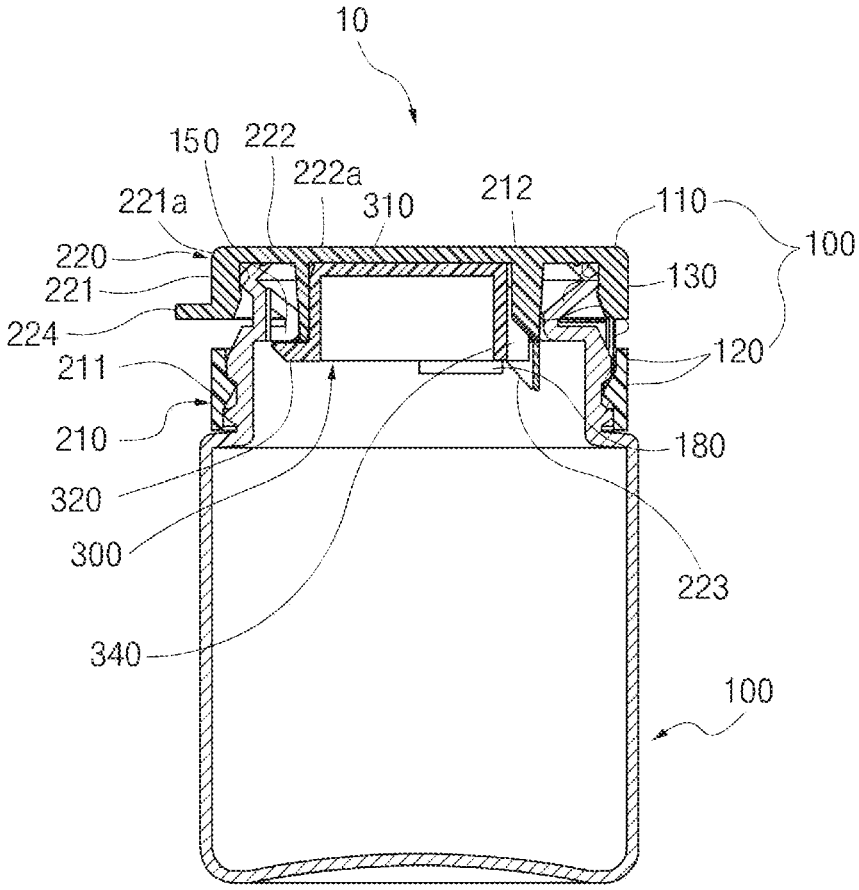
FIG. 8 is a cross-sectional view of an openable and closable safety container for a hazardous material according to another embodiment of the present invention.
Figure 9:
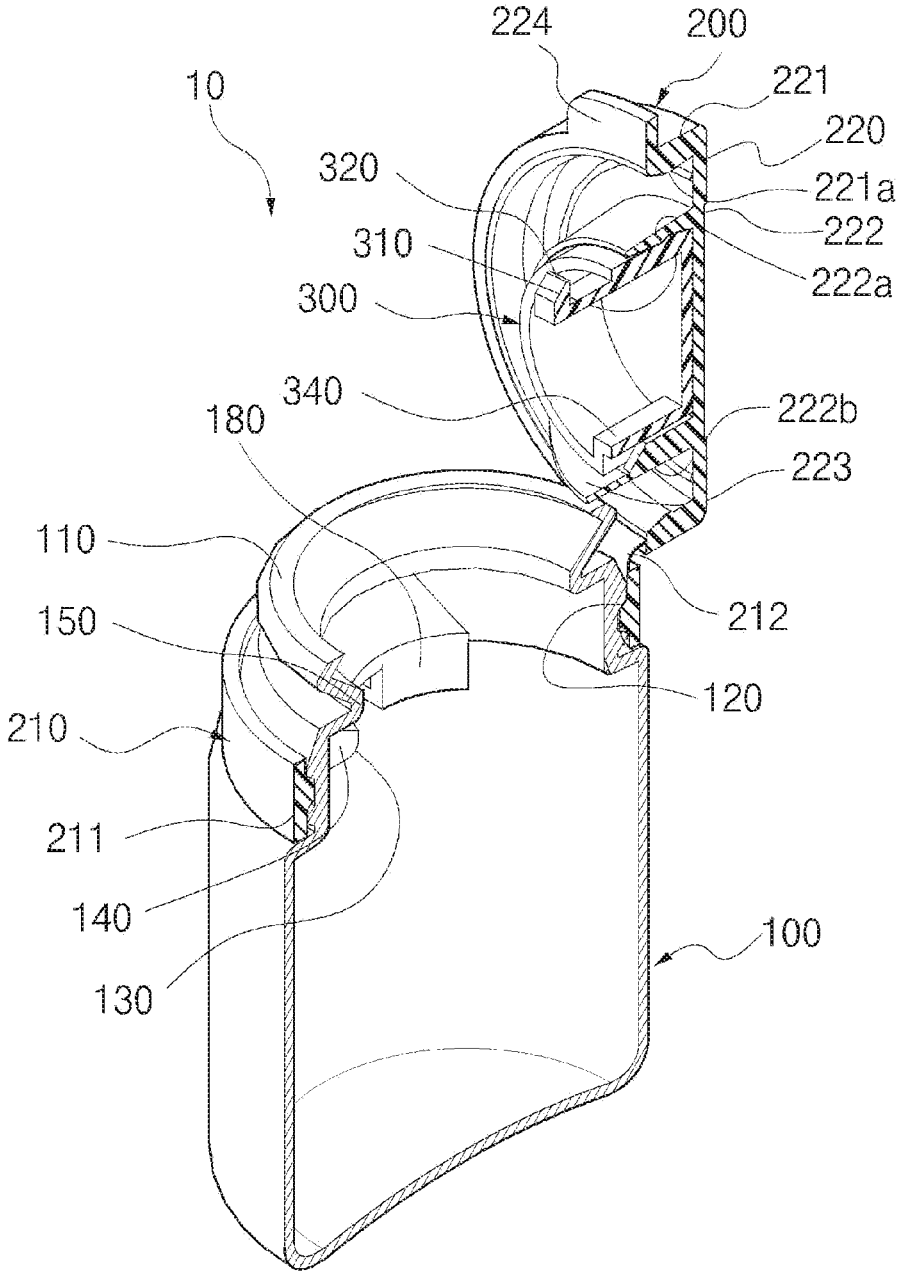
FIG. 9 is a cross-sectional perspective view showing a state before the openable and closable safety container of FIG. 8 is opened.
Figure 10:
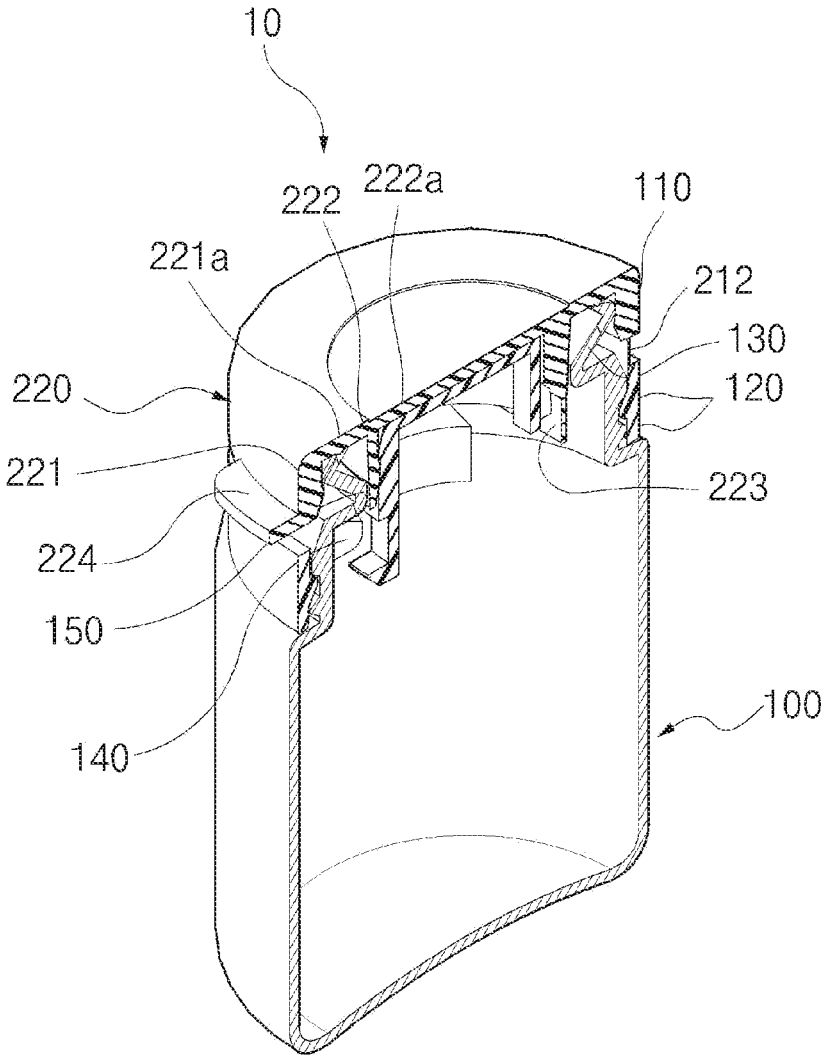
FIG. 10 is a cross-sectional perspective view showing a state after the openable and closable safety container of FIG. 8 is opened.

As shown in FIGS. 8 to 10, the safety container according to another embodiment of the present invention comprises: a container part 100 having an entrance end portion 110 whose top is opened, a guide step 120 formed in a stepwise fashion along its outer circumferential surface below the entrance end portion 110, a sealing protrusion 150 protruded in a stepwise fashion on its inner circumference at the lower end of the entrance end portion 110, and a stepped latching portion 130 protruded in a stepwise fashion on its inner circumference at the lower end of the entrance end portion 110 and having an elongated groove 140 partially formed therein, the stepped latching portion 130 being more inwardly protruded than the sealing protrusion 150; a lid part 200 having a freely bendable linker 212, a belt means 210 having a slide step 211 formed along its inner circumferential surface so as to be turnably coupled to the stepped latching portion 130 of the container part 100, a cover means 220 integrally connected to the belt means 210 by the linker 212, a sealing flange 221 provided in a vertical downward direction at a circumferential edge of the cover means 220 to allow a stepped sealing portion 221*a* protruding from its inner circumference to be elastically latched to an outer circumference of the entrance end portion 110 of the container part 100, a coupling flange 222 provided inside the sealing flange 221 to have the same center of curvature as the sealing flange 221, so that an outer circumference of the coupling flange 222 is in close contact with the stepped latching portion 130 upon being coupled to the container part 100, thereby hermetically sealing the container part 100, a stepped coupling portion 222*a* formed along the inner circumferential surface of the coupling flange 222, and a knob 224 extending from an outer circumference of the sealing flange 221; and a safety locking part 300 having a fixing step 310 formed along its outer circumferential surface to be coupled to an inner circumference of the coupling flange 222 of the lid part 200 and be elastically latched to the stepped coupling portion 222*a* of the lid part 200 so that it is joined integrally to the lid part 200, and a locking protrusion 320 curved inward from a lower portion of the fixing step to be protruding outward from its lower end, the locking protrusion 320 being operated integrally with the lid part 200 without interfering with the sealing protrusion 150 of the container part 100 to be positioned at a lower end of the stepped latching portion 130 through the elongated groove 140 of the container part 100 and to optionally maintain or unlock the latched state between the lid part 200 and the container part 100 by a turn of the lid part 200.

Figure 13:
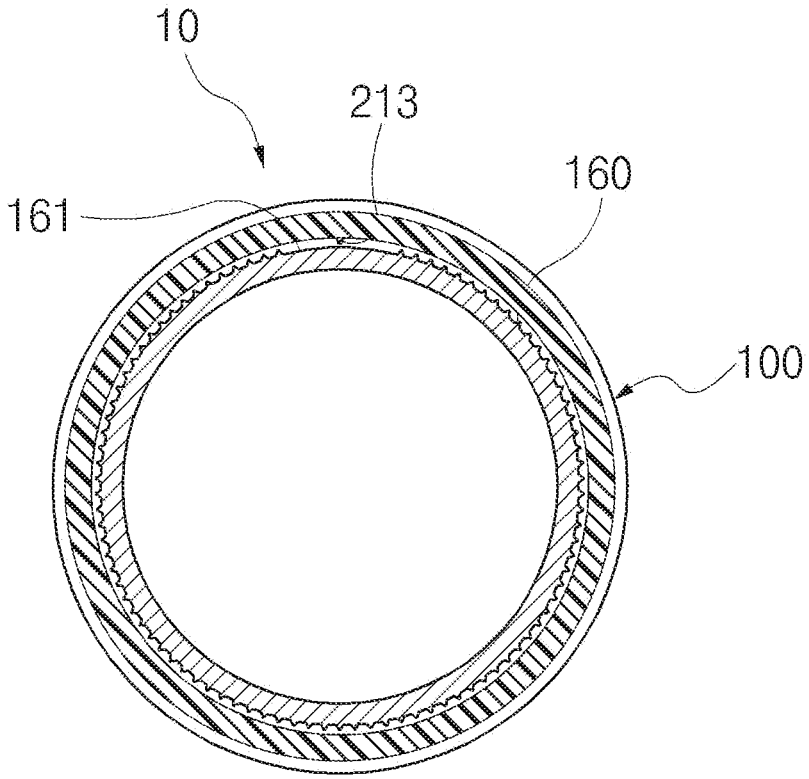
FIG. 13 is a cross-sectional view taken along the line A-A' of FIG. 12.

The safety container 10 further comprises indicator projections formed successively in a row along the outer circumferential surface of the container part 100 between the steps of the guide step 120 of the container part 100 and a position display end portion 161 formed in the indicator projections to have the same width as the elongated groove 140 of the container part 100 so that a frictional projection 213 formed under the slide step 211 of the belt means 210 is partially engaged with the indicator projections to generate a frictional sound between the indicator projections 160 and the frictional projection 213 upon being turned to open the lid part 200 from the container part 100 or to generate no frictional sound when the locking protrusion 320 is positioned in the elongated groove 140 and the frictional projection is escaped from the indicator projections to be positioned at the position display end portion 161 (FIG. 13).

That is, when a user turns the lid part 200 to open the lid part 200 in a locked state with the container part 100 by the safety locking part 300, the frictional projection 213 is turned along the indicator projections 160 to generate a frictional sound, which represents that the lid part 200 and the container part 100 are in a locked state. When the frictional projection 213 is escaped from the indicator projections to be positioned at the position display end portion 161 having a planar surface, the frictional sound disappears, which represents that the locking protrusion 320 of the safety locking part 300 is positioned in the elongated groove 140 of the container part 100. Therefore, the user can check the locked state between the lid part 200 and the container part 100 depending on whether the frictional sound is generated or disappears (FIG. 13).

Figure 2:
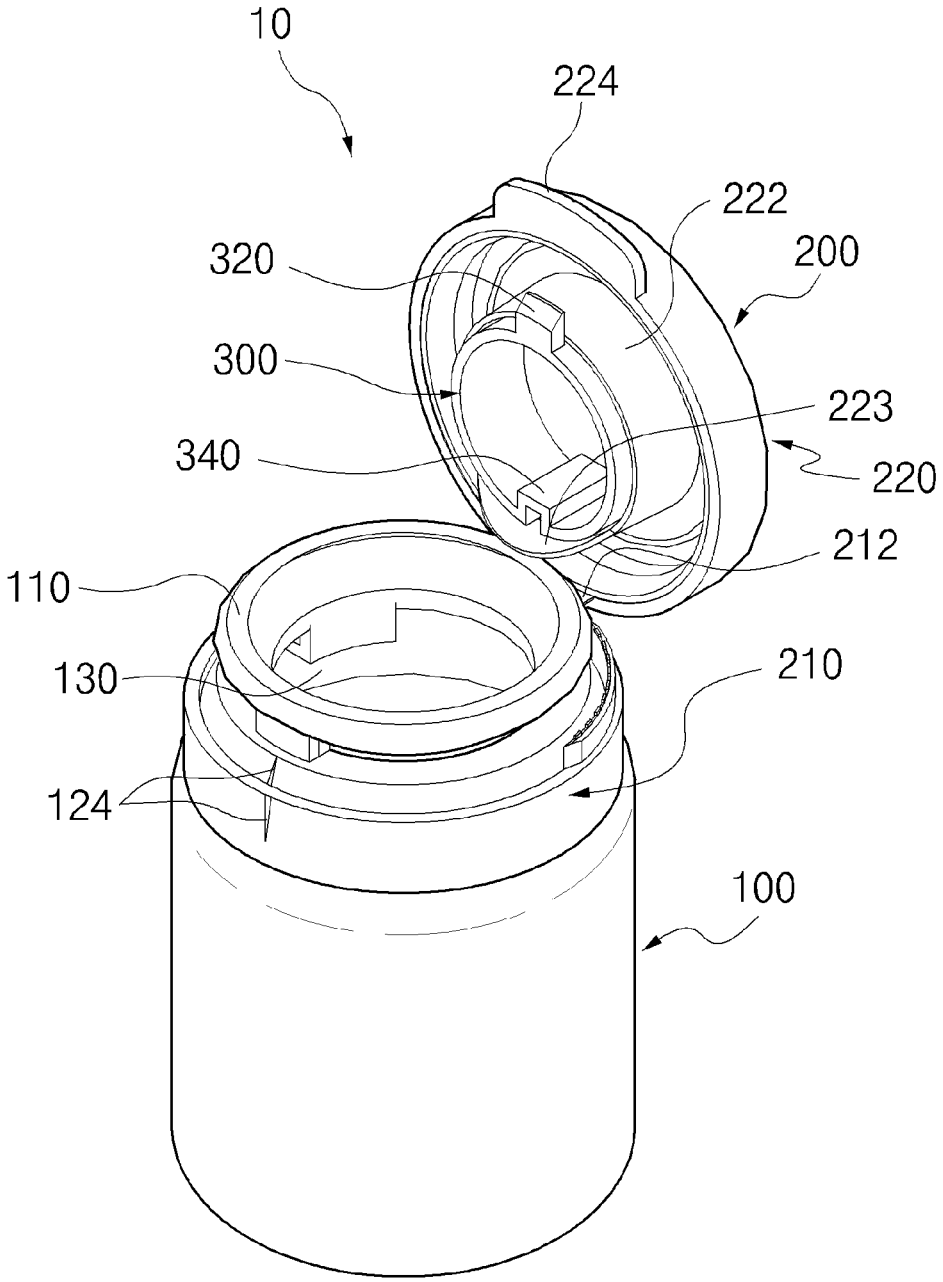
FIG. 2 is a perspective view showing a state in which a lid part of an openable and closable safety container for a hazardous material according to the present invention is opened.
Figure 3:
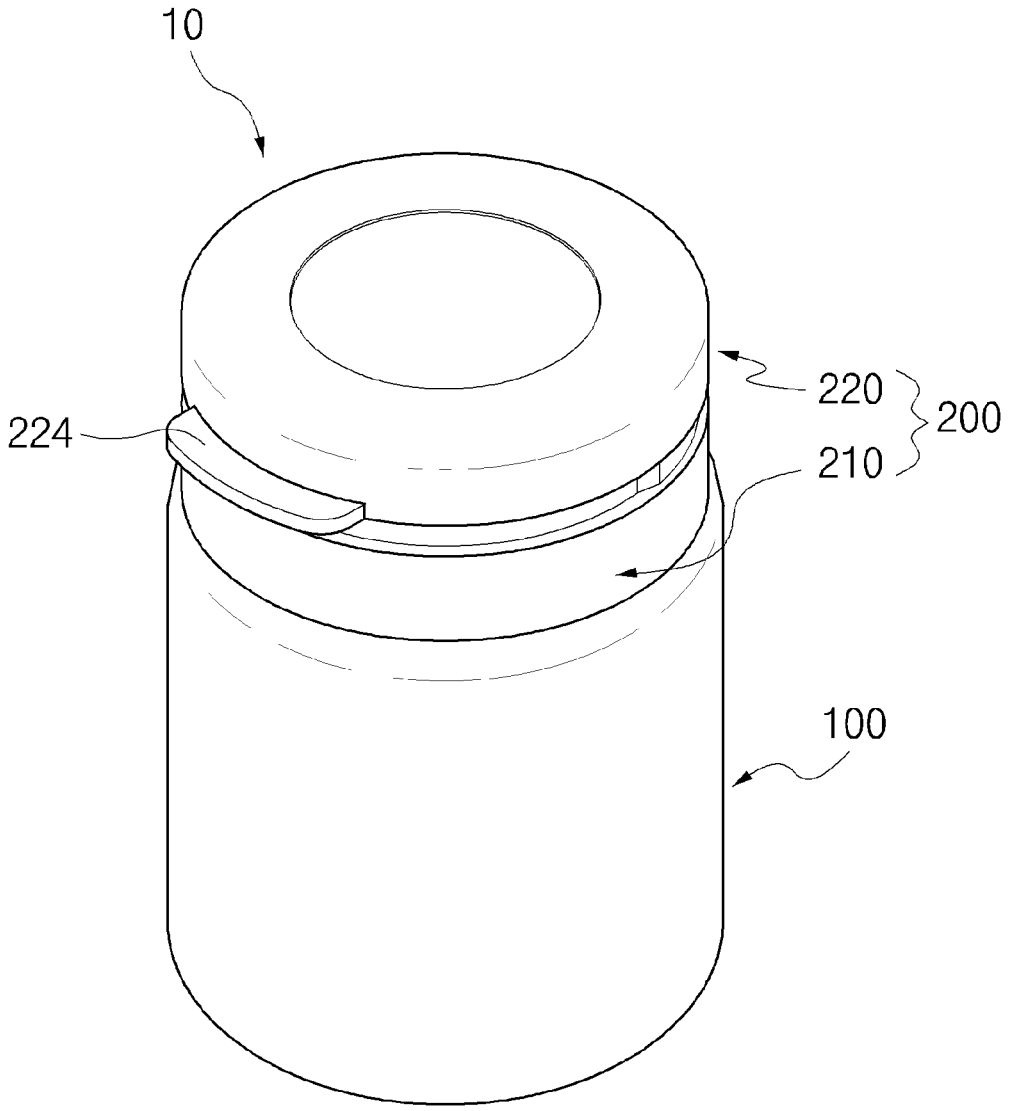
FIG. 3 is a perspective view showing a state in which a lid part of an openable and closable safety container for a hazardous material according to the present invention is closed.
Figure 4:
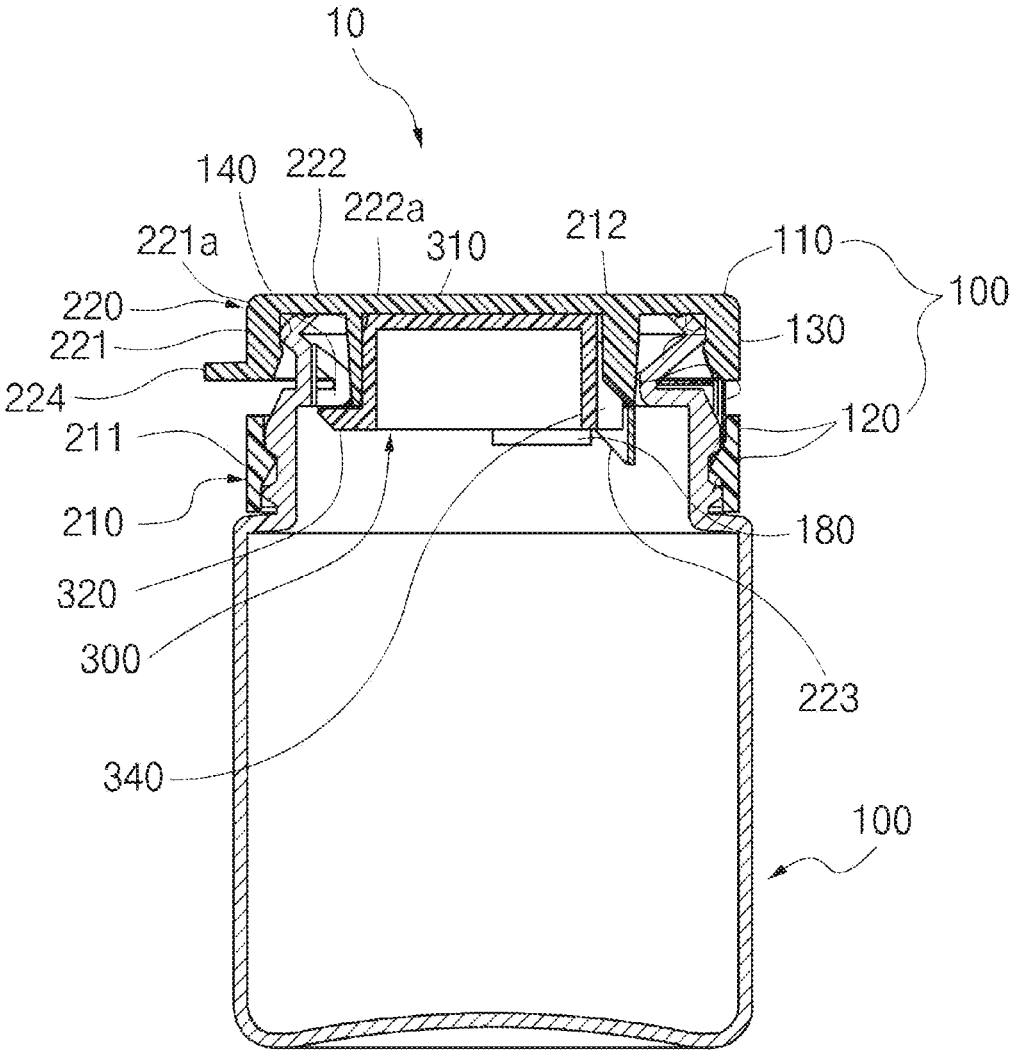
FIG. 4 is a cross-sectional view showing a state before an openable and closable safety container for a hazardous material according to the present invention is opened.

Further, reference lines 214 are formed on the belt means 210 of the lid part 200 and the container part 100. Specifically, one of the reference lines 214 indicating the central location of the elongated groove 140 is formed on the entrance end portion 110 of the container part 100 and the other reference line 214 indicating the central location of the locking protrusion 320 is formed on an outer circumference of the belt means 210. When the reference lines 214 are matched, the locking protrusion 320 is positioned in the elongated groove 140 of the container part 100, which indicates that the locked state is unlocked (FIG. 2).

The lid part 200 further has a linear jaw 223 extending from a rear end of the coupling flange 222 and latched to the entrance end portion 110 of the container part 100 to limit the opening/closing angle of the lid part 200, which is opened and closed from the container part 100 by the linker 212.

Figure 5:
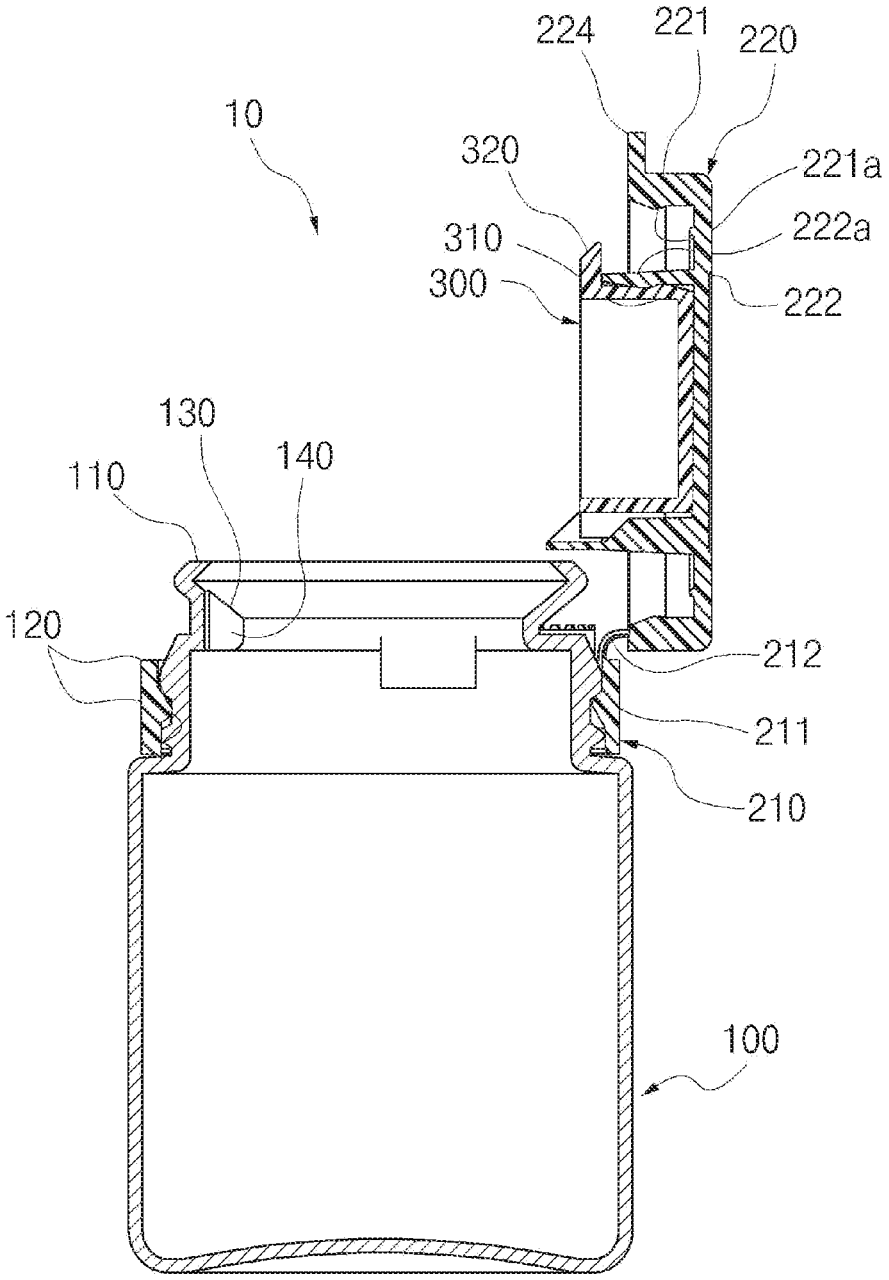
FIG. 5 is a cross-sectional view showing a state after an openable and closable safety container for a hazardous material according to the present invention is opened.
Figure 6:
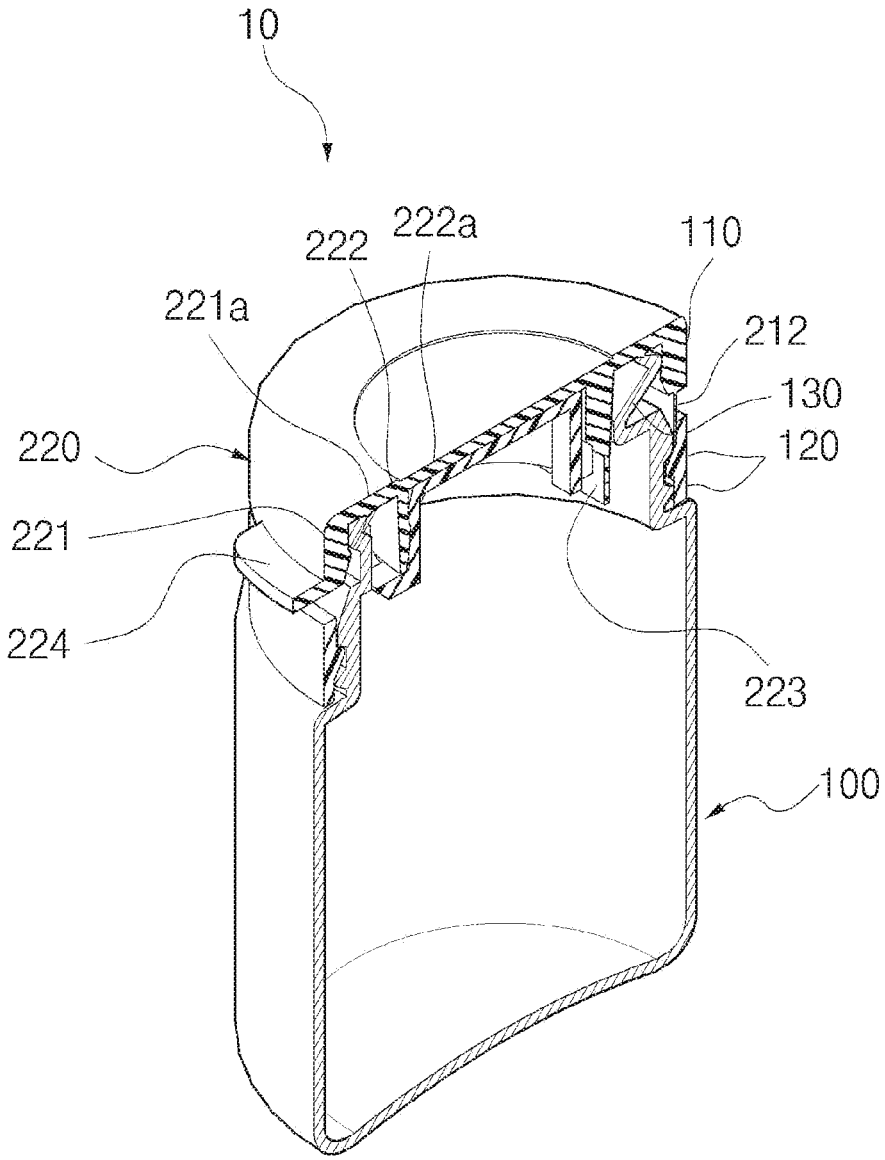
FIG. 6 is a cross-sectional perspective view showing a state before an openable and closable safety container for a hazardous material according to the present invention is opened.
Figure 7:
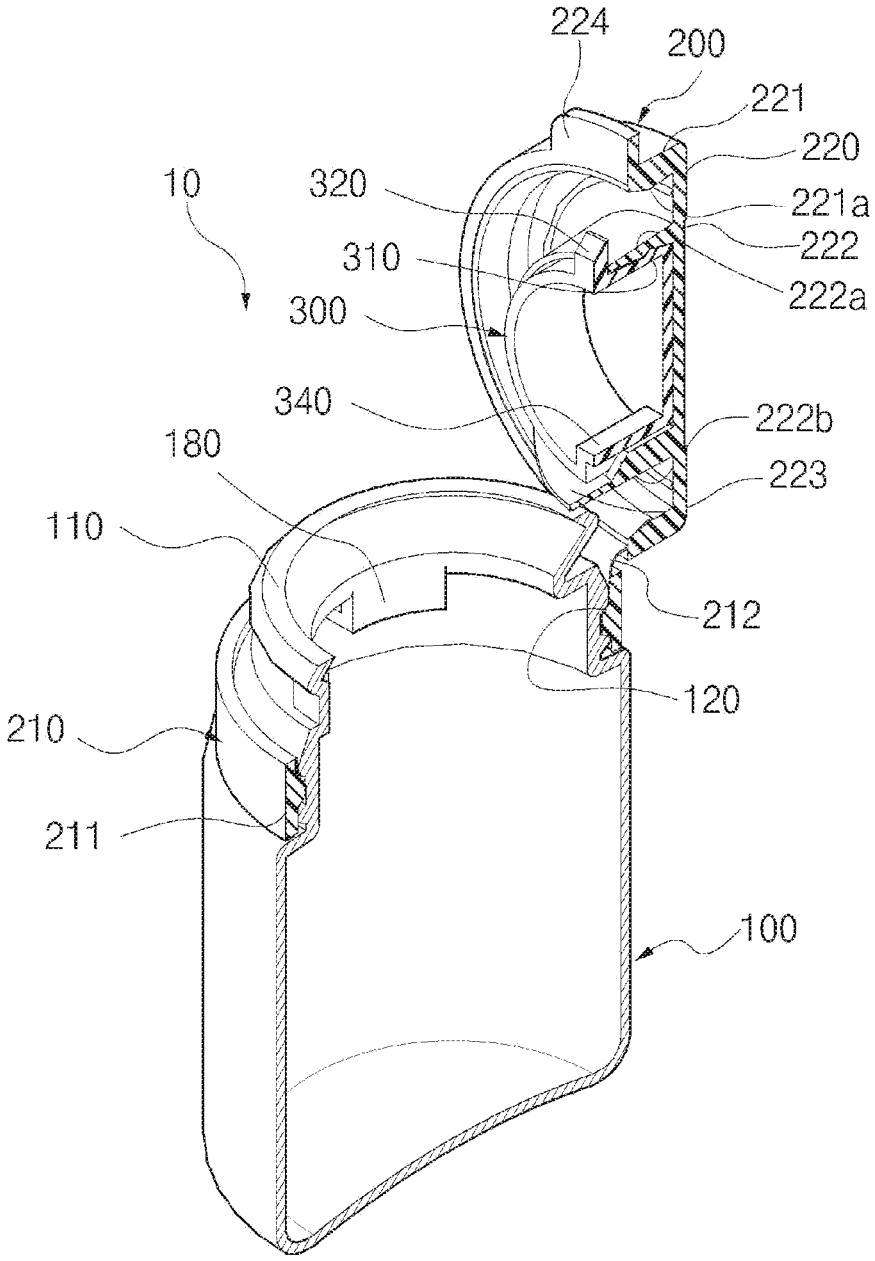
FIG. 7 is a cross-sectional perspective view showing a state after an openable and closable safety container for a hazardous material according to the present invention is opened.

The linearly extended jaw 223 serves to prevent a content of the container part 100 from flowing out of the container part 100 by fluctuation, which is generated when a user pushes the knob 224 of the lid part 200 upward by hand to completely open the lid part 200 in a safety unlocked state from the container part 100 by applying an excessive force to the knob 224 (FIGS. 5 and 10).

The container part 100 further has turning stoppers 180 formed symmetrically to each other on the inner circumference of the entrance end portion 110 of the container part 100 to limit the turning angle of the lid part 200 when the position of the locking protrusion 320 of the safety locking part 300 matches the elongated groove 140 of the container part 100 to open the lid part 200 or when the lid part 200 is turned to place the lid part 200 in a locked state after being opened. The turning stoppers 180 enable the lid part 200 to be opened in a rapid and efficient manner in the next step.

The lid part 200 further has a guide protrusion 222*b* formed in a vertical position on an inner circumference of the coupling flange 222 and the safety locking part 300 has a guide recess 340 formed in a position corresponding to the guide protrusion 222*b* on its outer circumference so that the guide protrusion 222*b* is fitted into the guide recess 340 to allow the safety locking part 300 to be coupled to the lid part 200 in an exact position, thereby facilitating the assembly of the safety container 10 (FIG. 1).

Figure 11:
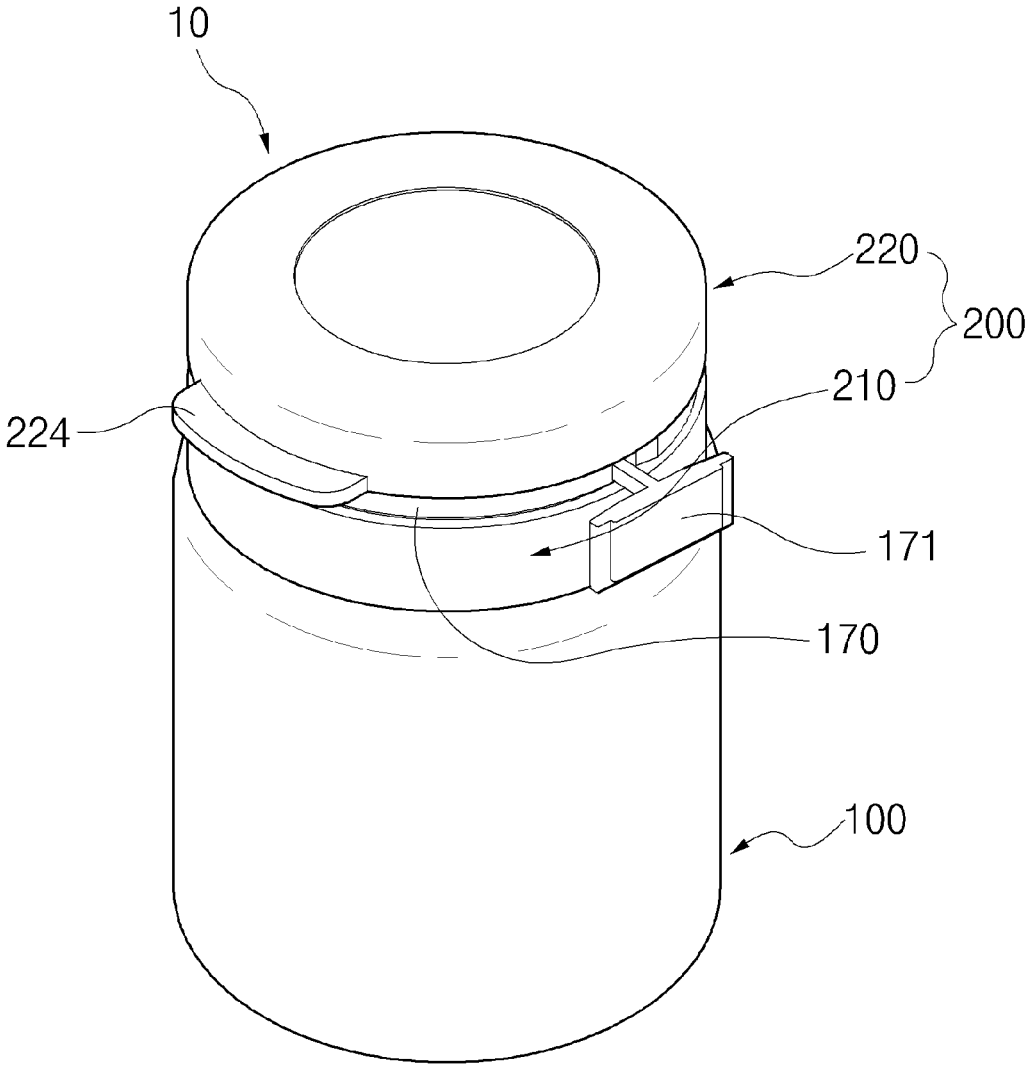
FIG. 11 is a perspective view showing a tear strip and a grasping member of an openable and closable safety container for a hazardous material according to the present invention.
Figure 12:
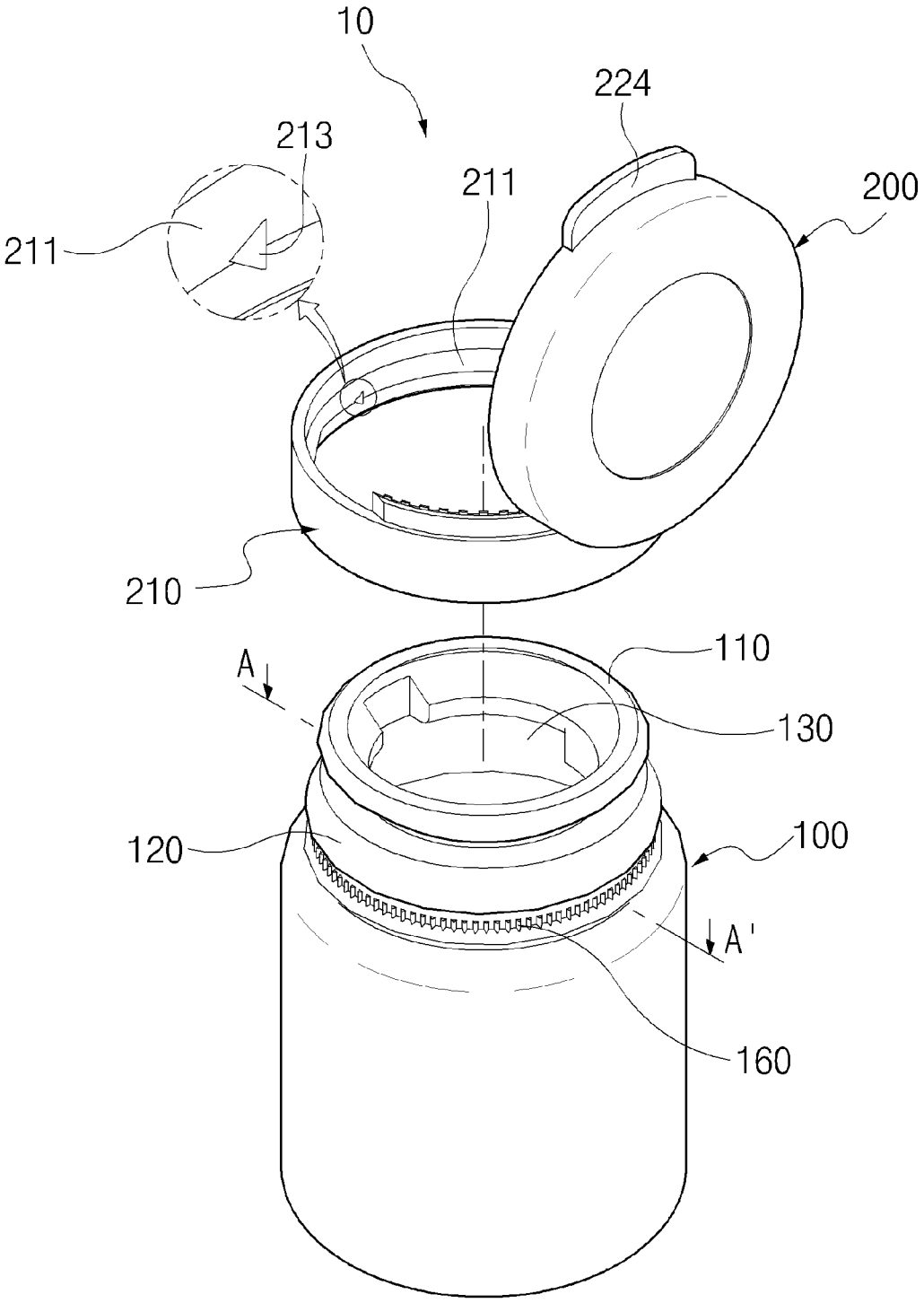
FIG. 12 is an exploded perspective view showing an elongated groove of an openable and closable safety container for a hazardous material according to the present invention.

The container part 100 further has a broken-type tear strip 170 integrally joined along the end portion of its outer circumferential surface corresponding to the cover means 220 and the belt means 210 of the lid part 200 to check and maintain the initial state of the safety container 10 before opening after the lid part 200 is coupled to the container part 100 accommodating a content, and a grasping member 171 provided at one lateral end of the tear strip 170. With this configuration, a user can hold the grasping member 171 and separate the tear strip 170 along an outer circumferential surface of the container part 100 (FIG. 11).

Mode for the Invention

First, the grasping member 171 of the safety container filled with a household chemical, such as a detergent or an adhesive, or a drug is pulled along an outer circumference of the container part 100 to separate the broken-type tear strip 170 from the cover means 220 and the belt means 210 of the lid part 200.

Thereafter, when it is intended to open the lid part 200 from the container part 100, the grasping member 171 of the lid part 200 is pushed upward to turn the lid part 200 upward with respect to the linker 212. As a result, the lid part 200 is opened from the container part 100.

At this time, the safety locking part 300 operated with the lid part 200 is separated outside through the elongated cutaway groove 140 partially formed in the stepped latching portion 130 to allow the lid part 200 to be opened from the container part 100, and at same time, the extended jaw 223 of the lid part 200 is latched to the entrance end portion 110 of the container part 100 to restrict the opening angle of the lid part 200 so that the content of the container part 100 does not flow out of the container part 100 by fluctuation, which is generated when the lid part 200 is opened.

After the lid part 200 is opened from the container part 100, the content is withdrawn from the container part 100. Thereafter, the lid part 200 is placed on the container part 100, turned toward the entrance end portion 110 of the container part 100 to safely lock the container part 100, and pressurized to allow the stepped sealing portion 221*a* of the sealing flange 221 of the lid part 200 to be in close contact with the curved outer circumferential surface of the entrance end portion 100, thereby isolating the internal space of the container part 100 from the outside.

Further, the locking protrusion 320 of the safety locking part 300 operated with the lid part 200 is positioned at a lower end of the stepped latching portion 130 through the elongated groove 140 of the container part 100 and the outer circumference of the safety locking part 300 is in close contact with the inner circumference of the stepped latching portion 130 so that the sealing state of the container part 100 can be maintained in a double structure by the lid part 200.

Particularly, the sealing protrusion 150 and the stepped latching portion 130 are formed in a double structure on the inner circumference of the entrance end portion 110 of the container part 100 to be coupled to the sealing flange 221 and the coupling flange 222 of the lid part 200 in a double structure so that the container part 100 and the lid part 200 can be sealed in a double structure, thereby preventing the content of the container part 100 from being deteriorated in quality by ambient air.

Next, the lid part 200 is turned within an angle range of the pair of the turning stoppers 180 such that the locking protrusion 320 positioned at a lower end of the elongated groove 140 is escaped from the elongated groove 140 and positioned at a lower end of the stepped latching portion 130, thereby achieving a safety locked state.

After the safety locked state is achieved by a turn of the lid part 200, the lid part 200 is not opened from the container part 100 even when the lid part 200 is pushed upward. This closed state of the lid part 200 is because the locking protrusion 320 is latched to the stepped latching portion 130.

Thereafter, when the lid part 200 is turned to unlock the safety container 10 in a safety locked state, the frictional projection 213 of the lid part 200 is turned along the indicator projections 160 formed successively in a row along the outer circumferential surface of the container part 100 to generate a frictional sound. When the locking protrusion 320 is positioned in the elongated groove 140 of the stepped latching portion 130, and at the same time, the frictional projection 213 is positioned at the position display end portion 161 having a planar surface, the frictional sound disappears generated by the indicator projections 160. Therefore, the user can readily discern the time when the safety locked state can be unlocked.

In addition to the frictional sound, the user can check whether the reference line formed on the belt means 210 of the lid part 200 matches that formed on an outer circumference of the entrance end portion 110 of the container part 100 by visual observation so that he/she can decide the time when the safety locked state can be unlocked.

After the safety locked state is unlocked, the lid part 200 can be reopened by pushing the grasping member 171 upward.

As apparent from the above description, the safety container of the present invention satisfies safety guidelines for household chemical goods and drugs in connection with the protection of infants and children. In addition, the safety container of the present invention allows adults to easily open it but do not permit infants and children to take a content out of it within a given time. Therefore, the safety container of the present invention is very useful for the prevention of infants and children's addiction and poisoning to hazardous household chemical goods and drugs.

The foregoing embodiments and accompanying drawings do not serve to limit the scope of the present invention. Accordingly, those skilled in the art will appreciate that various substitutions, modifications and changes are possible, without departing from the scope and spirit of the present invention as disclosed in the accompanying claims.

The invention claimed is:

1. A reclosable safety container comprising:

a container part having an entrance end portion whose top is open, a stepped latching portion formed at the lower end of the entrance end portion so as to be protruded inward and having an elongated groove partially formed therein, and a guide step formed on an outer circumferential surface of the container part at a lower portion of the stepped latching portion;

a lid part having a linker, a belt member turnably coupled to the guide step of the container part, and a cover means integrally connected to the belt member by the linker to open and close the entrance end portion; and a safety locking part coupled to the lid part in a vertical downward direction to be operated integrally with the lid part and having a locking protrusion protruding outward from an outer circumferential surface of the safety locking part, the locking protrusion being positioned in the stepped latching portion or the elongated groove by a turn of the lid part to optionally open or close the lid part.

2. The safety container according to claim 1, wherein the lid part is further characterized in that the belt member has a slide step formed along an inner circumferential surface of the belt member so as to be turnably coupled to the guide step of the container part, a sealing flange is provided in a vertical downward direction at a circumferential edge of the cover means to allow a stepped sealing portion protruding from an inner circumference of the sealing flange to be latched to an outer circumference of the entrance end portion, a coupling flange is provided inside the sealing flange to have a same center of curvature as the sealing flange, a stepped coupling portion is formed along the inner circumferential surface of the coupling flange, and a knob is extending from an outer circumference of the sealing flange; and wherein the safety locking part is further characterized in that a fixing step is formed along an outer circumferential surface of the safety locking part to be coupled to an inner circumference of the coupling flange of the lid part and latched to the stepped coupling portion of the lid part so that it is joined integrally to the lid part, and the locking protrusion is protruding outward from the lower end of the safety locking part for said optionally opening or closing the lid part by said turn of the lid part.

3. The safety container according to claim 1, wherein the container part is further characterized in that a sealing protrusion is protruding in a stepwise fashion on an inner circumference of the container part at the lower end of the entrance end portion, and the stepped latching portion is protruding in a stepwise fashion on an inner circumference of the container part at the lower end of the entrance end portion and having the elongated groove partially formed therein, the stepped latching portion being more inwardly protruded than the sealing protrusion;

wherein the lid part is further characterized in that the belt member has a slide step formed along an inner circumferential surface of the belt member so as to be turnably coupled to the guide step of the container part, a sealing flange is provided in a vertical downward direction at a circumferential edge of the cover means to allow a stepped sealing portion protruding from an inner circumference of the sealing flange to be latched to an outer circumference of the entrance end portion of the container part, a coupling flange is provided inside the sealing flange to have a same center of curvature as the sealing flange, so that an outer circumference of the coupling flange is in close contact with the stepped latching portion upon being coupled to the container part, thereby hermetically sealing the container part, a stepped coupling portion is formed along the inner circumferential surface of the coupling flange, and a knob is extending from an outer circumference of the sealing flange; and wherein the safety locking part is further characterized in that a fixing step is formed along an outer circumferential surface of the safety locking part to be coupled to an inner circumference of the coupling flange of the lid part and latched to the stepped coupling portion of the lid part so that it is joined integrally to the lid part, and the locking protrusion protruding outward from the lower end of the safety locking part for said optionally opening or closing the lid part by said turn of the lid part.

4. The safety container according to claim 2, further comprising indicator projections formed successively in a row along the outer circumferential surface of the container part between steps of the guide step of the container part and a position display end portion formed in the indicator projections to have the same width as the elongated groove of the container part so that a frictional projection formed under the slide step of the belt member is partially engaged with the indicator projections to generate an audible frictional sound between the indicator projections and the frictional projection upon being turned to open the lid part from the container part or to generate no audible frictional sound when the locking protrusion is positioned in the elongated groove and the frictional projection is escaped from the indicator projections to be positioned at the position display end portion.

5. The safety container according to claim 1, wherein the lid part further has a linear jaw extending from a rear end of the coupling flange and latched to the entrance end portion of the container part to limit an opening/closing angle of the lid part, which is opened and closed from the container part by the linker.

6. The safety container according to claim 2, wherein the container part further has turning stoppers formed symmetrically to each other on the inner circumference of the entrance end portion of the container part to limit a turning angle of the lid part.

7. The safety container according to claim 2, wherein the lid part further has a guide protrusion formed in a vertical position on an inner circumference of the coupling flange and the safety locking part has a guide recess formed in a position corresponding to the guide protrusion on its outer circumference so that the guide protrusion is fitted into the guide recess to allow the safety locking part to be coupled to the lid part in an exact position.

8. The safety container according to claim 3, further comprising indicator projections formed successively in a row along the outer circumferential surface of the container part between steps of the guide step of the container part and a position display end portion formed in the indicator projections to have the same width as the elongated groove of the container part so that a frictional projection formed under the slide step of the belt member is partially engaged with the indicator projections to generate an audible frictional sound between the indicator projections and the frictional projection upon being turned to open the lid part from the container part or to generate no audible frictional sound when the locking protrusion is positioned in the elongated groove and the frictional projection is escaped from the indicator projections to be positioned at the position display end portion.

9. The safety container according to claim 2, wherein the lid part further has a linear jaw extending from a rear end of the coupling flange and latched to the entrance end portion of the container part to limit an opening/closing angle of the lid part, which is opened and closed from the container part by the linker.

10. The safety container according to claim 3, wherein the container part further has turning stoppers formed symmetrically to each other on the inner circumference of the entrance end portion of the container part to limit a turning angle of the lid part.

11. The safety container according to claim 3, wherein the lid part further has a guide protrusion formed in a vertical position on an inner circumference of the coupling flange and the safety locking part has a guide recess formed in a position corresponding to the guide protrusion on its outer circumference so that the guide protrusion is fitted into the guide recess to allow the safety locking part to be coupled to the lid part in an exact position.

* * * * *